US011808540B2

(12) United States Patent
Rainaud et al.

(10) Patent No.: US 11,808,540 B2
(45) Date of Patent: Nov. 7, 2023

(54) SAFETY MECHANISM FOR BLOWBACK FIREARM

(71) Applicant: Sig Sauer, Inc., Newington, NH (US)

(72) Inventors: Tyler Rainaud, Nottingham, NH (US); Jesse D. Cole, Newmarket, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 17/696,070

(22) Filed: Mar. 16, 2022

(65) Prior Publication Data

US 2023/0296335 A1 Sep. 21, 2023

(51) Int. Cl.
*F41A 3/10* (2006.01)

(52) U.S. Cl.
CPC ..... *F41A 3/10* (2013.01)

(58) Field of Classification Search
CPC ..... F41A 17/74; F41A 17/76
USPC ..... 42/70.08; 89/27.12
See application file for complete search history.

(56) References Cited

U.S. PATENT DOCUMENTS 4,021,955 A * 5/1977 Curtis ..... F41A 17/72 42/70.08
4,313,274 A * 2/1982 Ludwig ..... F41A 17/72 42/70.08
4,593,601 A 6/1986 Smith
5,157,209 A * 10/1992 Dunn ..... F41A 19/32 89/154
6,234,059 B1 5/2001 Fuchs et al.
6,256,918 B1 * 7/2001 Szabo ..... F41A 17/72 89/154
6,286,240 B1 * 9/2001 Collins ..... F41A 17/066 42/70.08
6,401,379 B1 6/2002 Moon
6,993,864 B1 2/2006 O'Clair et al.
D598,065 S 8/2009 Vukovic et al.
D654,978 S 2/2012 Karanian et al.
8,316,754 B2 11/2012 Gugliada
D681,131 S 4/2013 Su
8,448,364 B2 5/2013 Davidson
D690,374 S 9/2013 Lee
(Continued)

OTHER PUBLICATIONS

Sturm, Ruger & Co., Inc., "Instruction Manual for Ruger American Pistol Pro Model" (2016).
(Continued)

*Primary Examiner* — Bret Hayes
(74) *Attorney, Agent, or Firm* — Finch & Maloney PLLC

(57) ABSTRACT

A breechblock assembly includes a breechblock configured to reciprocate along a top of the firearm receiver between a recoil position and a battery position. An actuator is coupled to the breechblock and is configured to move between first and second positions. A lever on the breechblock in contact with the actuator is movable between a blocking position and a non-blocking position. For example, the lever is generally oriented along the central axis and extends rearward beyond a proximal face of the breechblock. When the actuator is in the first position, the lever is in the blocking position. When the actuator is in the second position the lever is in the non-blocking position. When assembled in a firearm, an end of the lever is positioned to block the hammer from striking the firing pin when the breechblock is out of battery by more than a predefined distance.

19 Claims, 7 Drawing Sheets

(56) References Cited

U.S. PATENT DOCUMENTS

| | | | |
|---|---|---|---|
| D692,513 | S | 10/2013 | Yigit |
| 9,021,730 | B2 | 5/2015 | Gentilini et al. |
| D744,049 | S | 11/2015 | Chu |
| 9,194,654 | B1 | 11/2015 | Viani |
| D754,802 | S | 4/2016 | Martelli et al. |
| 9,303,936 | B2 | 4/2016 | Toner |
| 9,310,160 | B1 | 4/2016 | Dichario |
| D755,324 | S | 5/2016 | Martelli et al. |
| D755,907 | S | 5/2016 | Hu |
| D758,519 | S | 6/2016 | Toner et al. |
| 9,441,897 | B2 | 9/2016 | Mather et al. |
| 9,546,831 | B2 | 1/2017 | Bandini et al. |
| 9,551,550 | B2 | 1/2017 | Wells |
| 9,664,471 | B1 | 5/2017 | Curry et al. |
| D791,262 | S | 7/2017 | Brown et al. |
| D803,341 | S | 11/2017 | Wolf |
| D808,487 | S | 1/2018 | Beville et al. |
| D814,593 | S | 4/2018 | O'Clair et al. |
| D814,596 | S | 4/2018 | Curry |
| D815,233 | S | 4/2018 | Toner et al. |
| D823,969 | S | 7/2018 | Beville et al. |
| D828,881 | S | 9/2018 | Keung |
| D828,892 | S | 9/2018 | Kellgren |
| D830,480 | S | 10/2018 | Chu |
| 10,088,269 | B2 | 10/2018 | Sheets, Jr. et al. |
| D834,656 | S | 11/2018 | Chu |
| 2001/0037596 | A1 | 11/2001 | Salvitti |
| 2005/0011100 | A1* | 1/2005 | Fluhr ..... F41A 17/04 42/70.08 |
| 2009/0071053 | A1* | 3/2009 | Thomele ..... F41A 11/02 42/70.08 |
| 2019/0154368 | A1 | 5/2019 | Kim et al. |

OTHER PUBLICATIONS

Sturm, Ruger & Co., Inc., "Instruction Manual for Ruger American Pistol, Standard Model" (2016).

Ruger American Pistol Pro Model Parts List, pp. 34-37 (2016).

* cited by examiner

SAFETY MECHANISM FOR BLOWBACK FIREARM

FIELD OF THE DISCLOSURE

This disclosure relates to firearm components and more particularly to a battery safety mechanism for a handgun or rifle utilizing blowback operation.

BACKGROUND

Firearms design involves many non-trivial challenges. Some semiautomatic handguns use a straight blowback action in which the inertia of firing a round is used to cycle the action. For a handgun chambered in .22 cal. or .380 ACP, for example, the energy to cycle the action comes from expanding propellant gases that push the cartridge case rearward upon firing the gun. As the case moves rearward it also drives the breechblock and slide rearward to cycle the action. In doing so, the breechblock also begins to separate from the barrel as the case begins to move rearward. After the slide moves rearward, a recoil spring returns the breechblock and slide forward while at the same time chambering a round. In a recoil-operated handgun, in contrast, the slide and breechblock are locked with the barrel and move rearward with the barrel for a short distance after firing to ensure the projectile has exited the barrel prior to unlocking and opening the breach. Some small-bore semiautomatic rifles and submachine guns also use blowback system.

SUMMARY

One aspect of the present disclosure relates to a mechanism for a firearm that prevents contact between the hammer and firing pin when the slide is out of battery. The mechanism can be used in a handgun or rifle using blowback action, such as one chambered for rimfire ammunition (e.g., .22 LR). The safety mechanism can be applied to handguns with hammer-fired or striker-fired actions. Numerous variations and embodiments will be apparent in light of the present disclosure.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
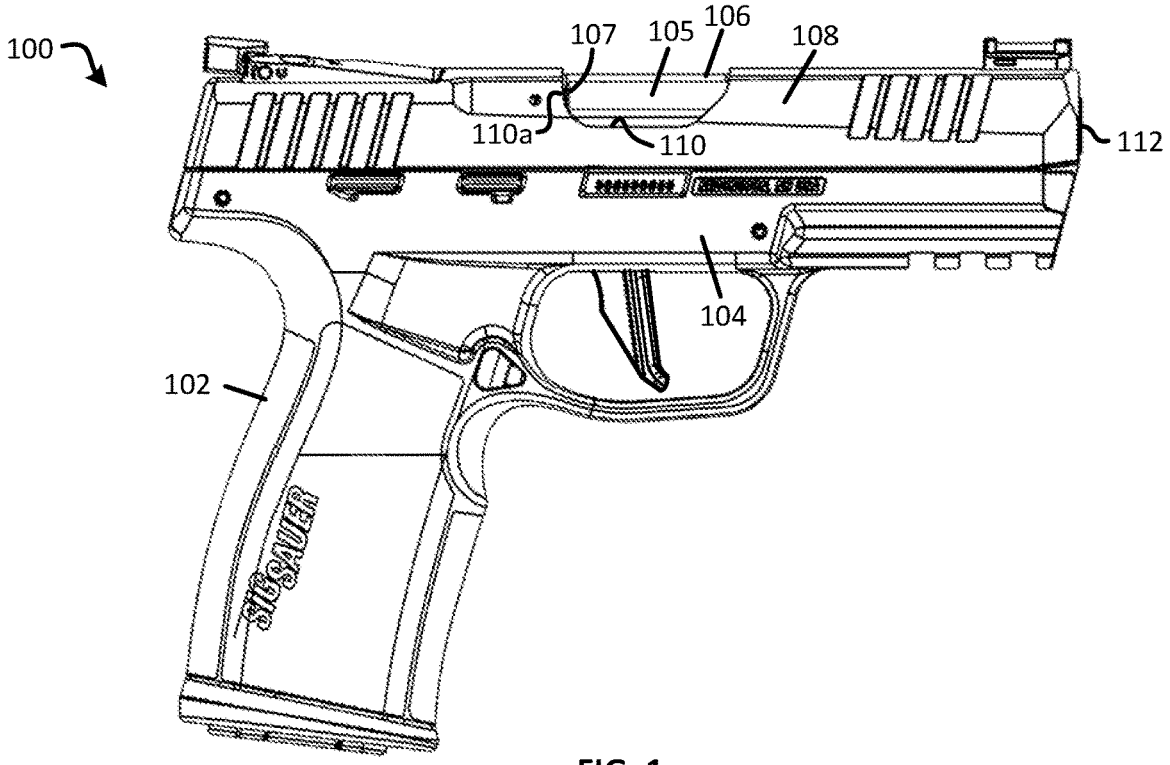
FIG. 1 illustrates a side view of a handgun with the slide and breechblock in a battery position, in accordance with an embodiment of the present disclosure.

These and other features of the present embodiments will be better understood by reading the following detailed description, taken together with the Figures herein described. For purposes of clarity, not every component may be labeled in every drawing. Furthermore, as will be appreciated, the figures are not necessarily drawn to scale or intended to limit the present disclosure to the specific configurations shown. In short, the Figures are provided merely to show example structures.

DETAILED DESCRIPTION

Disclosed is a safety mechanism for a firearm that prevents discharge of the firearm in an out-of-battery condition. In one example, the safety mechanism obstructs the hammer from striking the firing pin when the breechblock is out of battery by more than a predefined distance. For example, when the breechblock is out of battery by more than a predefined distance (e.g., 1 mm), a lever defaults to a blocking position that obstructs the hammer from striking the firing pin. As the breechblock moves into battery, a pin moves the lever to a non-blocking position where the hammer can strike the firing pin. For example, the pin can be oriented vertically with a lower end of the pin positioned to engage a cam surface on the receiver when the breechblock is within the predefined distance of the battery position. As the breechblock continues forward, the pin is displaced upward, which moves the blocking lever to a non-blocking position. However, if the breechblock fails to move sufficiently to the battery position, the lift pin remains in the lowered position and the lever remains in the blocking position. The mechanism can be utilized in firearms utilizing a blowback method of operation, including hammer-fired handguns, striker-fired handguns, and small bore rifles, in accordance with some embodiments.

General Overview

Safety continues to be an important challenge for firearms designers. Handguns can be made with external safety levers that are activated by the user. Handguns can also have one or more internal safeties that prevent discharge when the firearm is dropped, for example.

One non-trivial issue of firearms design and performance pertains to the possibility of firing the gun when the breech block is slightly out of battery (e.g., more than 1 mm). For example, a breechblock on a blowback handgun may fail to completely close and remain in an out-of-battery position.

The out-of-battery condition can result from dirty or damaged parts, bad or improper ammunition, a weak slide return spring, or interference with the slide during blowback (e.g., by contact with the user's hand), for example. Since the breech is not completely closed in an out-of-battery condition, firing the gun in this state means that the pressure of the fired cartridge is not contained within the chamber and can release through the breech or other unintended locations. The result can be damage to the gun and harm to the operator.

In some semiautomatic handguns, such as a handgun chambered for centerfire ammunition, the rear corner of the breechblock is rounded, also referred to as the hammer ramp. As the breechblock moves rearward, the hammer ramp contacts the hammer and returns it to the cocked position. In some handguns, the hammer ramp contacts the hammer at a point that is close to the pivot pin so that the contact point is effective to block the hammer from striking the firing pin unless the breech mechanism is in battery. However, in handguns chambered for rimfire ammunition, lower peak forces of combustion are available to cock the hammer during rearward movement of the slide. For this reason, the radius of the rear corner of the breechblock (e.g., the "hammer ramp") may be increased so that the breechblock contacts the hammer further away from the hammer pivot pin. The larger radius of the hammer ramp may still block the hammer from striking the firing pin at greater distances from the battery position. However, the increased radius causes the point of contact to be further away from the pivot point, allowing the hammer to rotate further towards the firing position. For this reason, the hammer ramp may fail to effectively prevent the hammer from striking the firing pin when the breechblock is a small distance out-of-battery. Accordingly, a need exists for an improved mechanism to prevent out-of-battery discharge in firearms. In addition to the hammer ramp, it is also desirable to have a redundant safety mechanism that prevents out-of-battery discharge.

To address this need and others, the present disclosure relates to a battery safety mechanism for semiautomatic handguns that utilize a blowback system. The battery safety mechanism can be configured to obstruct a hammer from striking a firing pin or configured to block a striker from impacting a primer when the breechblock is in an out-of-battery position. Accordingly, a safety mechanism as disclosed herein can be used in handguns and rifles having a blowback method of operation. For example, the safety mechanism is particularly useful for firearms configured for rimfire ammunition.

As will be appreciated in light of this disclosure, and in accordance with some embodiments, a battery safety mechanism can be part of a breech block in a semiautomatic handgun. A battery safety mechanism as disclosed herein is particularly useful in a handgun chambered for .22 LR, .17 HMR, or other rimfire ammunition (not shown in the drawings), and can be implemented in hammer-fired and striker-fired guns. The battery safety mechanism can be utilized in semiautomatic handguns where the breechblock is a distinct component from the slide as well as handguns where the breechblock is formed or machined as part of the slide. A battery safety mechanism as disclosed herein can also be implemented in small caliber rifles that utilize a blowback action. Other suitable host firearms and calibers will be apparent in light of this disclosure.

As used herein, terms referencing direction, such as upward, downward, vertical, horizontal, left, right, front, back, etc., are used for convenience to describe components of a handgun oriented in a traditional shooting position with the barrel extending horizontally in front of the user. Embodiments of the present disclosure are not limited by these directional references and it is contemplated that a firearm and its components in accordance with the present disclosure could be used in any orientation.

Also, it should be noted that, while generally referred to herein as a 'lift pin' for consistency and ease of understanding the present disclosure, the disclosed safety mechanism is not limited to that specific terminology and the lift pin alternatively can be referred to simply as a pin, an actuator, or other terms. As will be further appreciated, the particular configuration (e.g., orientation, materials, dimensions, etc.) of a safety mechanism configured as described herein may be varied, for example, depending on the particular firearm in which it is implemented and the intended use. Numerous configurations will be apparent in light of this disclosure

Structure and Function

Figure 2:
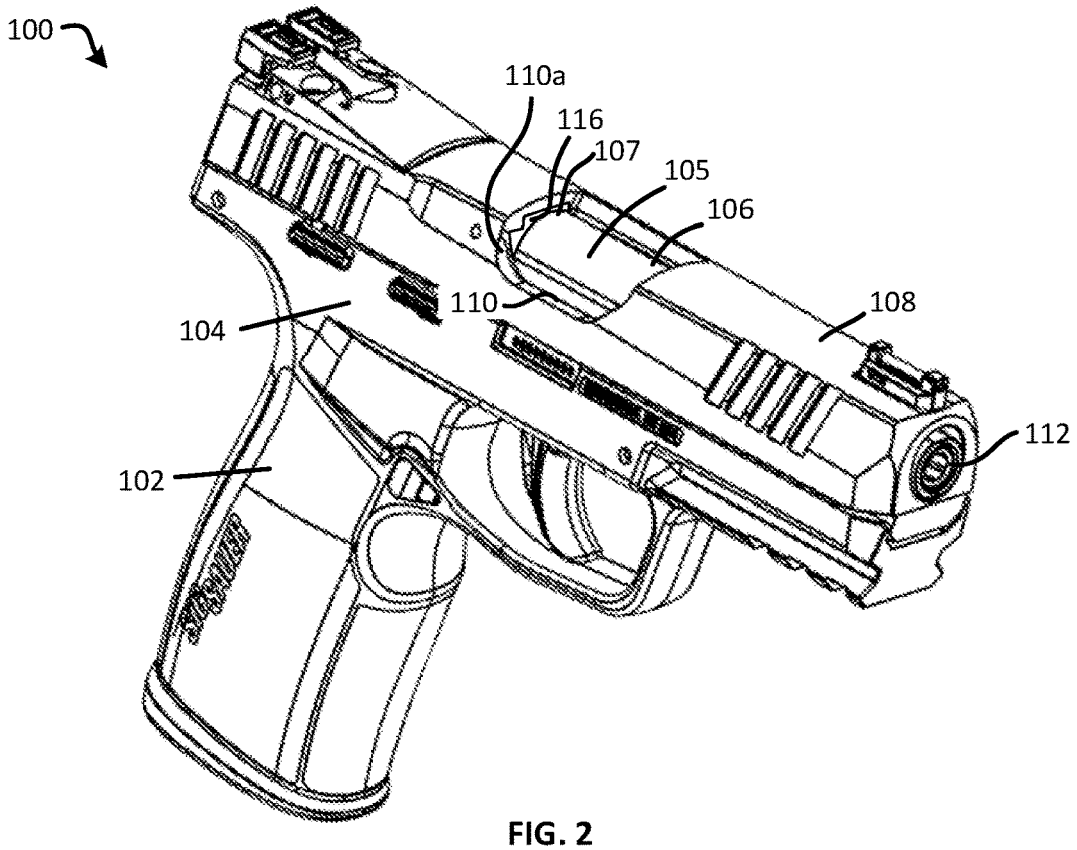
FIG. 2 illustrates a front and side perspective view of the handgun of FIG. 1.

FIGS. 1 and 2 illustrate a side view and a front perspective view, respectively, of a handgun 100 with the slide 108 and breechblock 116 in a battery position, in accordance with an embodiment of the present disclosure. The handgun 100 is configured as a semiautomatic handgun that includes a grip portion 102, a receiver 106 retained in a frame portion 104, and a slide 108 that can reciprocate along the receiver 106 during use. The handgun 100 uses blowback operation (not shown), rather than recoil operation, to cycle the action. The receiver 106 defines a chamber 105 with an entrance or breech 107 at its proximal end. A barrel 112 is fixedly connected to the chamber 105 and coaxially arranged with the bore axis for discharge of a projectile when firing the gun. The slide 108 defines an ejection port 110 for spent cartridges. A rear margin 110*a* of the ejection port 110 is substantially aligned with the breech 107 face of the chamber 105. Partly visible in FIG. 2, the breechblock 116 is in a battery position and closes the breech 107.

Figure 3:
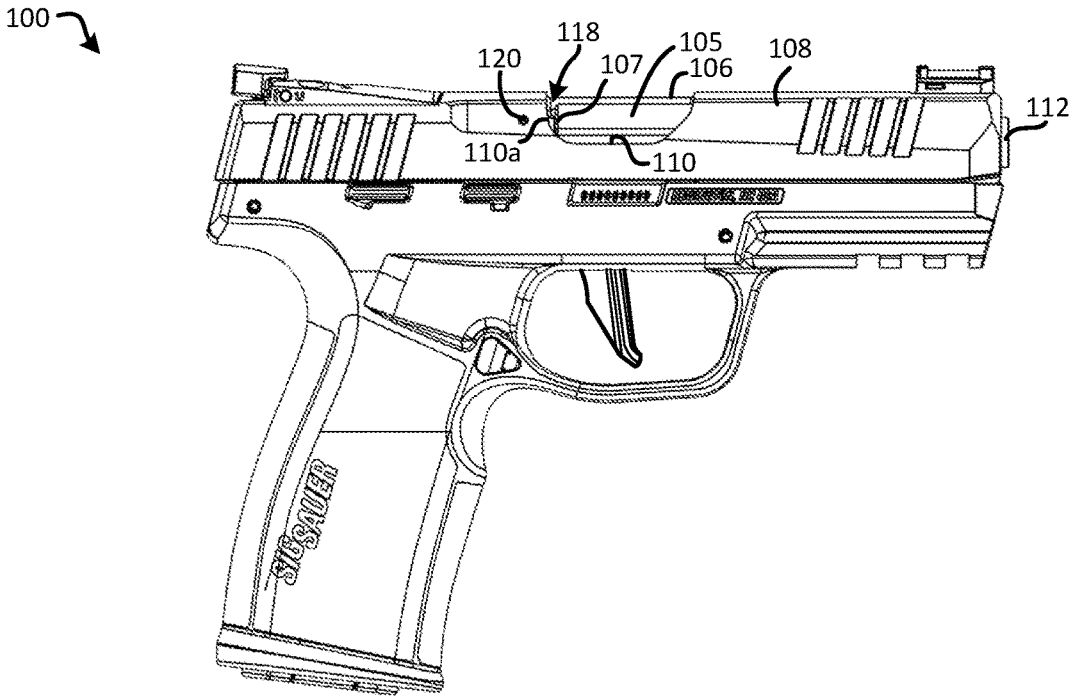
FIG. 3 illustrates a side view of a handgun with the slide and breechblock in an out-of-battery position, in accordance with an embodiment of the present disclosure.
Figure 4:
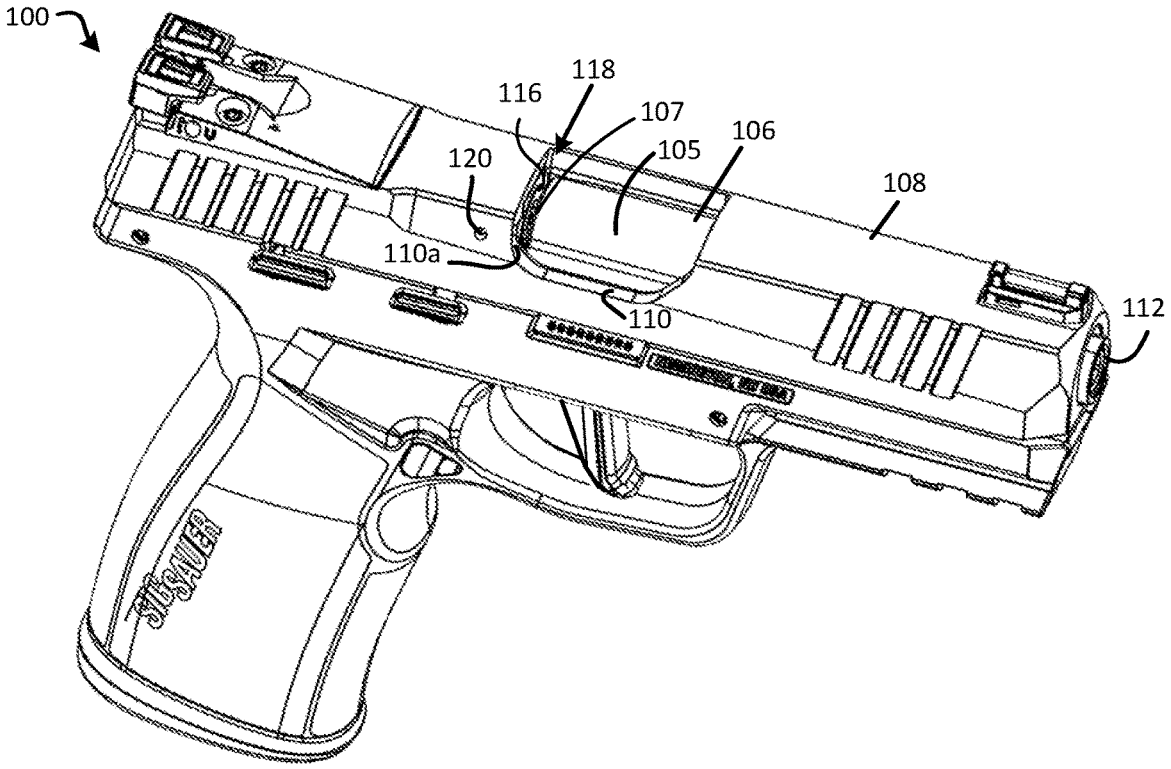
FIG. 4 illustrates a top and side perspective view of the handgun of FIG. 3.

FIGS. 3 and 4 illustrate a side view and a front perspective view, respectively, of the handgun 100 with the slide 108 and breechblock 116 in an out-of-battery position, in accordance with an embodiment of the present disclosure. In this example, a small gap 118 (~1 mm) exists between the breech 107 and the breechblock 116. The gap 118 is also between the breech 107 and the rear margin 110*a* of the ejection port 110. Compared to the substantially flush position shown in FIGS. 1-2, the barrel 112 protrudes slightly from the distal end of the slide 108. A retaining pin 120 extending crosswise through the slide 108 couples the breechblock 116 to the slide 108 so that the slide 108 and breechblock 116 move together. Upon firing the handgun 100, a lug on the breechblock 116 engages the retaining pin 120 so that the rearward motion of the fired round moves the breechblock 116 and slide 108 rearward as a group. Hand-racking the slide 108 can also move the breechblock 116 rearward, as will be appreciated.

Figure 5:
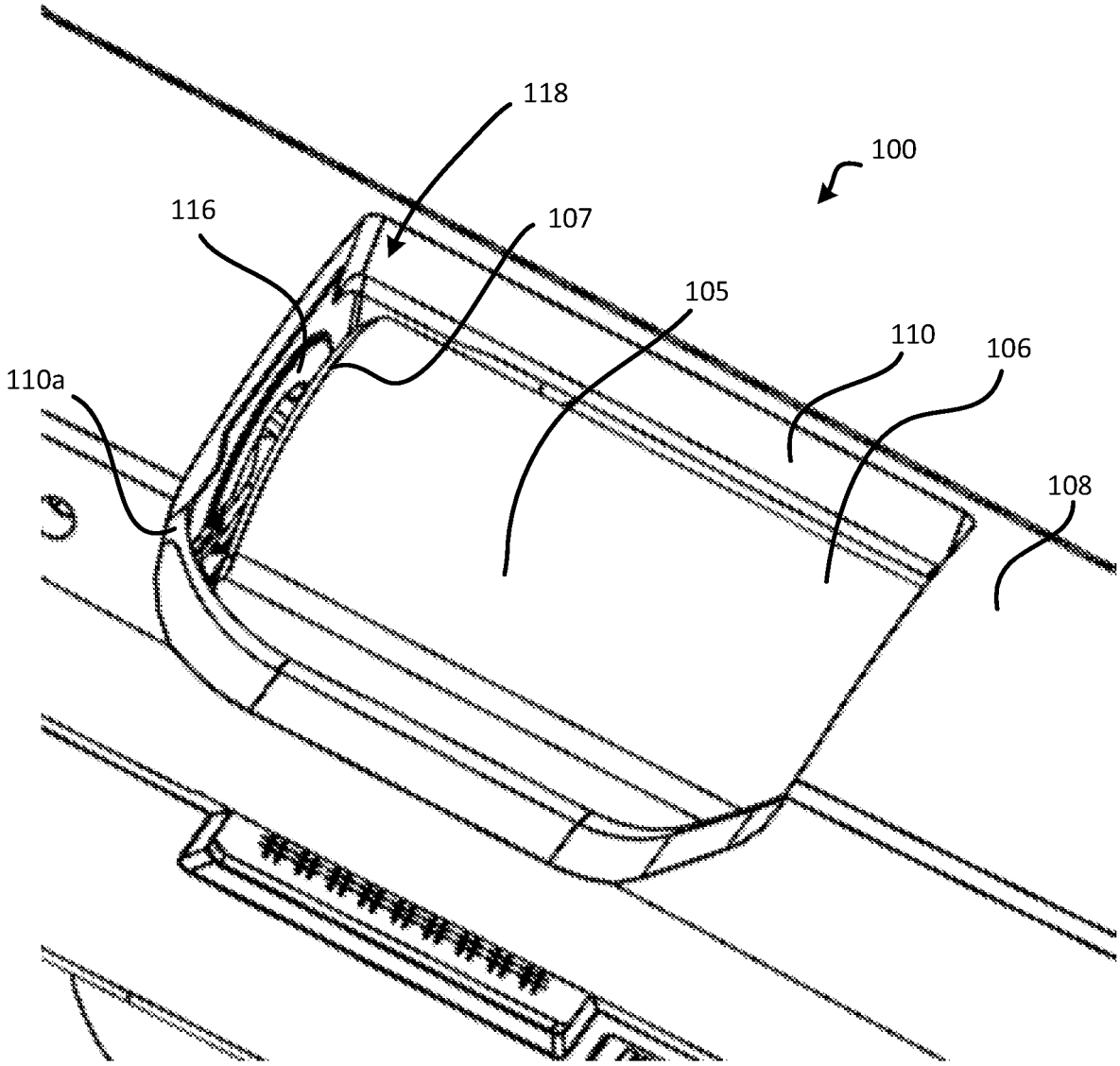
FIG. 5 illustrates a top perspective view showing the chamber and breechblock in an out-of-battery position, in accordance with an embodiment of the present disclosure.

FIG. 5 illustrates a close-up view looking into the ejection port 110 with the breechblock 116 and slide 108 in an out-of-battery position. The gap 118 between the breech 107 and breechblock 116 (and also between breech 107 and rear margin 110*a* of ejection port 110) results in an opening for gases to escape from the chamber 105 if the handgun 100 were fired in the out-of-battery position.

Figure 6:
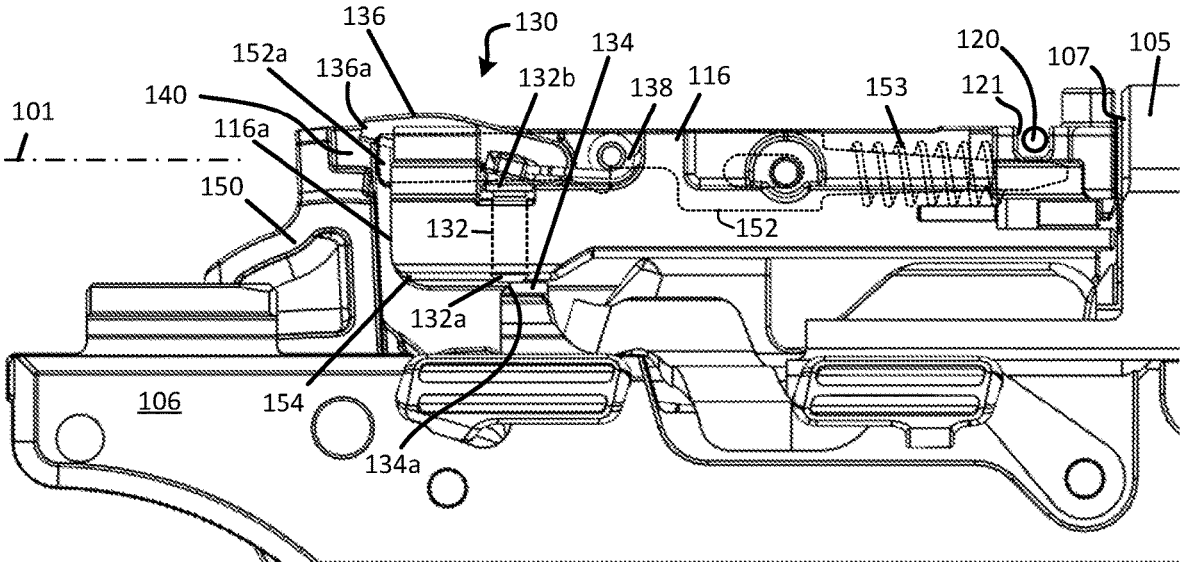
FIG. 6 illustrates a side view showing part of the receiver, components of a fire control assembly, and a safety mechanism in a non-blocking position, in accordance with an embodiment of the present disclosure.

FIG. 6 shows a side view showing components of a handgun with a safety mechanism 130, in accordance with an embodiment of the present disclosure. The slide 108 and grip module are omitted to more clearly show the receiver 106, breechblock 116, and fire control components. The safety mechanism 130 is configured to prevent fire in an out-of-battery condition by blocking the hammer from striking the firing pin in an out-of-battery condition.

In this example, the breechblock 116 is in the battery position and closes the chamber 105 by abutting the breech 107. As such, the hammer 150 is able to strike the proximal end 152*a* of the firing pin 152, which extends longitudinally through the breechblock 116 along a central axis 101 and is biased to a rearward position with a firing pin spring 153. Much of the firing pin 152 is shown in broken lines in FIG. 6. Here, the hammer 150 is shown in its fire position in contact with the end 152*a* firing pin 152. Note also that the curved lower corner 154 of the breechblock 116, or hammer ramp 154, does not engage the hammer 150 in this battery position. Retaining pin 120 occupies a pin slot 121 extending crosswise through the top of the breechblock 116.

The safety mechanism 130 includes a lift pin 132 extending vertically through part of the breechblock 116 as well as a lever 136 that is pivotably attached to the breechblock and actuatable by the lift pin 132. A spring 138 and a cam 134 are also shown. In the battery position, a lower end 132*a* of the lift pin 132 engages a cam 134 on the receiver 106, causing the lift pin 132 to lift vertically against the force of the spring 138 and actuate (e.g., pivot) a lever 136 to a non-blocking position with respect to the hammer 150. For example, the lift pin 132 is slidably received in a bore or channel extending vertically through a portion of the breechblock 116, where the lower end 132*a* and upper end 132*b* of the pin 132 are exposed. The spring 138, such as a torsion spring, biases the lever 136 to the blocking position where it is positioned to contact the hammer 150. In some embodiments, the lever 136 generally extends horizontally in a rearward direction with an end 136*a* of the lever 136 extending beyond a proximal end or proximal face 116*a* of the breechblock 116. The end 136*a* of the lever 136 extends beyond the proximal face 116*a* by a greater amount than the end 152*a* of the firing pin 152 extends. Thus, in the blocking position the lever 136 obstructs the hammer 150 from striking the firing pin 152.

In some embodiments, the lever 136 is oriented horizontally when in the blocking position and is elevated slightly from horizontal in the non-blocking position. Preferably, the lever 136 is aligned with the direction of hammer force (e.g., is perpendicular to the face of the hammer) when the lever 136 is in the blocking position so as to reduce or eliminate the possibility that the hammer 150 deflects the lever 136 out of the way and continues on to strike the firing pin 152. When lifted by the lift pin 132 to the non-blocking position, such as shown in FIG. 6, the end 136*a* of the lever 136 can be received in a notch, pocket, or recess 140 defined in the hammer 150. In other embodiments, the end 136*a* of the lever 136 is pivoted to be above the hammer 150 or otherwise misaligned with the hammer 150 so as to not obstruct the hammer 150 from striking the firing pin 152 in the non-blocking position.

As shown in FIG. 6, the lower end 132*a* of lift pin 132 is on a flat top of the cam 134, which maintains the lift pin 132 (and lever 136) in a lifted position while the breechblock 116 is in battery or within a predefined distance from battery. For example, the lever 136 is lifted to the non-blocking position when the breechblock 116 is 1.0 mm or less from the battery position. In other embodiments, the predefined distance is no more than 0.9 mm, no more than 0.8 mm, no more than 0.7 mm, no more than 0.6 mm, no more than 0.5 mm, no more than 0.4 mm, no more than 0.3 mm, or no more than 0.2 mm from the battery position. Within the predefined distance, the lever 136 may be raised by different amounts which each result in a non-blocking position, in accordance with some embodiments. The cam 134 also includes a sloped surface or ramp 134*a*, which causes the lift pin 132 to lift as the breechblock 116 moves forward and the lower end 132*a* of the lift pin 132 engages the ramp 134. As shown in FIG. 6, the lower end 132*a* of the lift pin 132 can have a sloped face to engage the ramp 134*a*.

Figure 7:
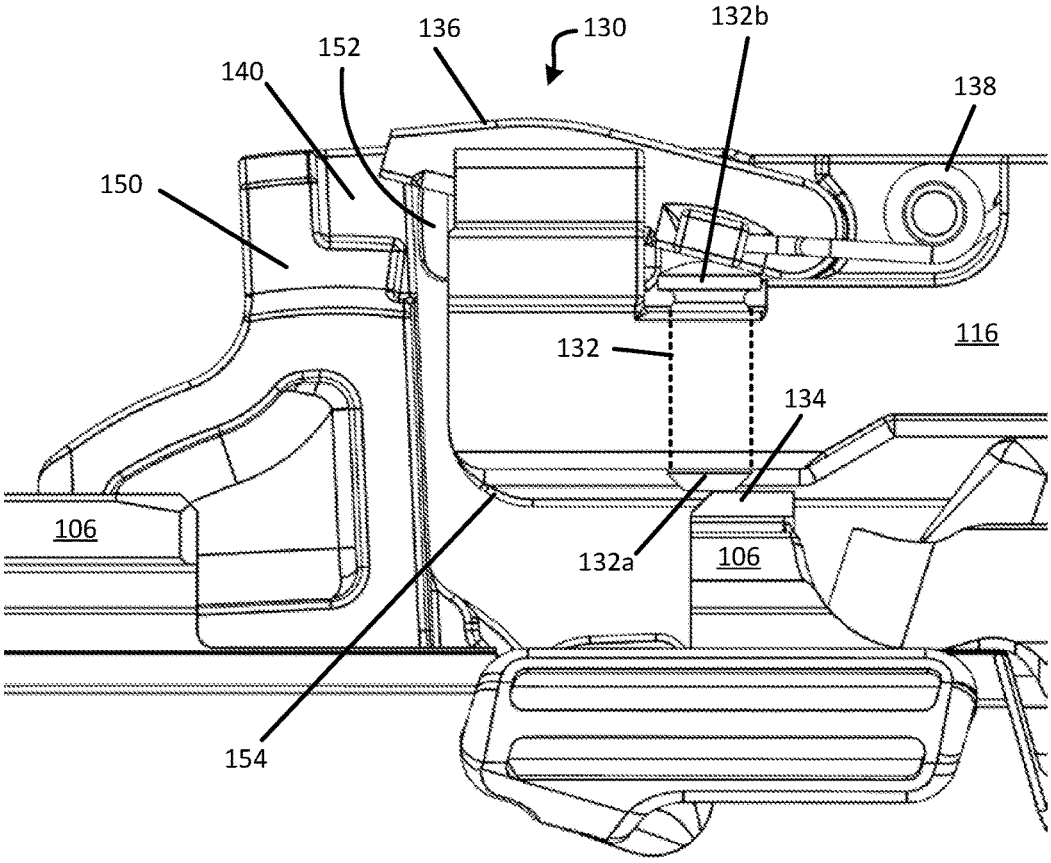
FIG. 7 illustrates a close-up, side view showing a safety mechanism in a non-blocking position, in accordance with an embodiment of the present disclosure.

FIG. 7 illustrates an enlarged side view showing components of the safety mechanism 130, hammer 150, and part of the receiver 106. The hammer 150 is in the fire position and contacts the firing pin 152. The hammer 150 clears the curved hammer ramp 154. The lift pin 132 is on top of the cam 134 in a second or raised position. In the raised position the upper end 132*b* of the lift pin 132 pivots the lever 136 to the non-blocking position. The spring 138, configured as a torsion spring in this example, engages the lever 136 and biases the lever 136 towards the blocking position. Thus, when the breechblock 116 moves rearward in response to firing the gun, for example, the lift pin 132 will move out of engagement with the cam 134 and will return to the first or lowered position and allow the lever 136 to resume the blocking position where it is aligned in the path of the hammer 150.

Figure 8:
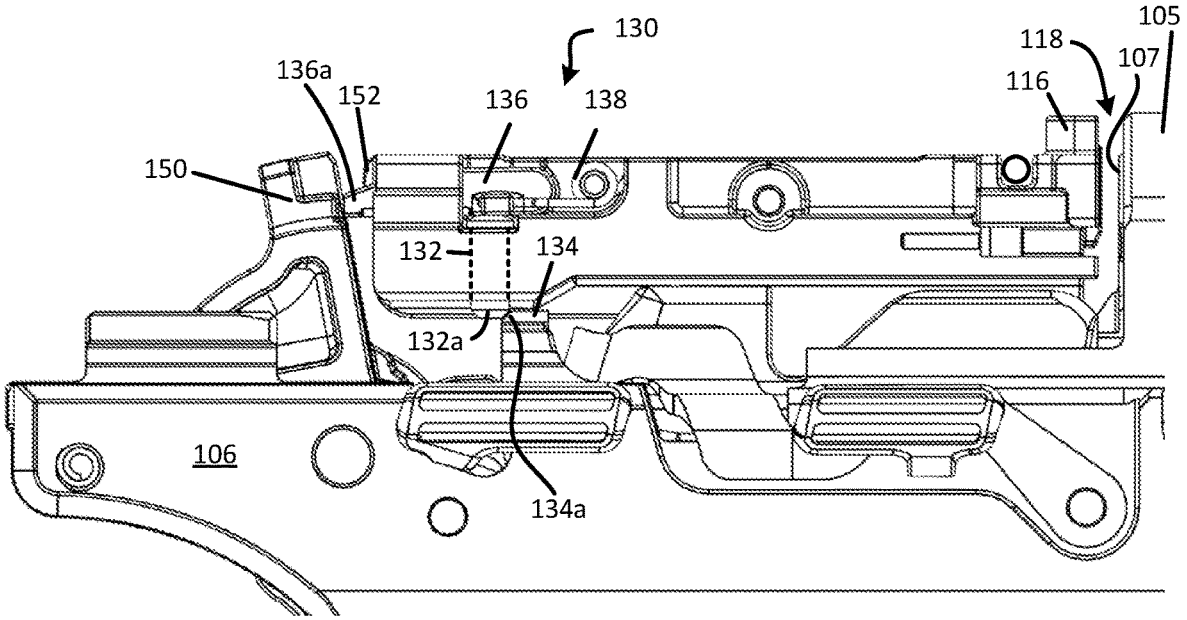
FIG. 8 illustrates a side view showing components of a handgun with the breechblock in an out-of-battery position and a safety mechanism in a blocking position, in accordance with an embodiment of the present disclosure.

FIG. 8 illustrates a side view showing components of a handgun with a safety mechanism 130, where the breechblock 116 is in an out-of-battery position, in accordance with an embodiment of the present disclosure. The slide 108 and grip module are omitted to more clearly show the receiver 106, breechblock 116, and fire control components.

In this example, the breechblock 116 is out of battery by about 1.0 mm. The out-of-battery condition is evidenced by the gap 118 between the breech 107 and the distal end of the breechblock 116. Here, the lift pin 132 and breechblock 116 have moved rearward a sufficient distance that the lower end 132*a* of the lift pin 132 has moved down the ramp 134*a* of the cam 134, or has otherwise disengaged the cam 134, to the extent that the lift pin 132 is in the lowered position. As a result, spring 138 has returned the lever 136 downward to the blocking position (e.g., horizontal) where it is aligned to block the hammer 150. Accordingly, although the hammer 150 has been released forward, the end 136*a* of the lever 136 blocks the hammer 150 and prevents it from striking the firing pin 152. Note also that the hammer ramp 154 of the breechblock 116 remains disengaged from the hammer 150 and therefore, in the absence of the safety mechanism 130, may not stop the hammer 150 from striking the firing pin 152.

Figure 9:
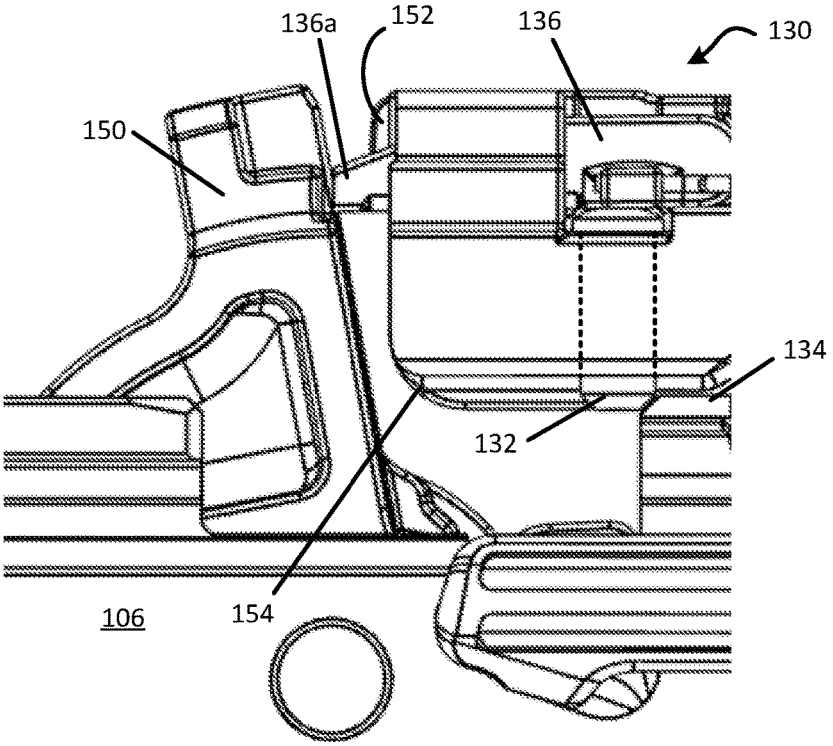
FIG. 9 illustrates a close-up, side view showing a safety mechanism in a blocking position, in accordance with an embodiment of the present disclosure.

FIG. 9 illustrates an enlarged side view showing components of the safety mechanism 130, hammer 150, and part of the receiver 106 with the safety mechanism 130 engaging the hammer, in accordance with an embodiment of the present disclosure. The hammer 150 has been released forward and has stopped in contact with the end 136*a* of the lever 136, which obstructs the hammer 150 from striking the firing pin 152. The hammer 150 remains disengaged from the hammer ramp 154. The lift pin 132 has sufficiently disengaged the cam 134 to return to the first or lowered position. The lever 136 is in the blocking position where it extends horizontally into the path of the hammer 150 and obstructs the hammer 150 from striking the firing pin 152.

Figure 10:
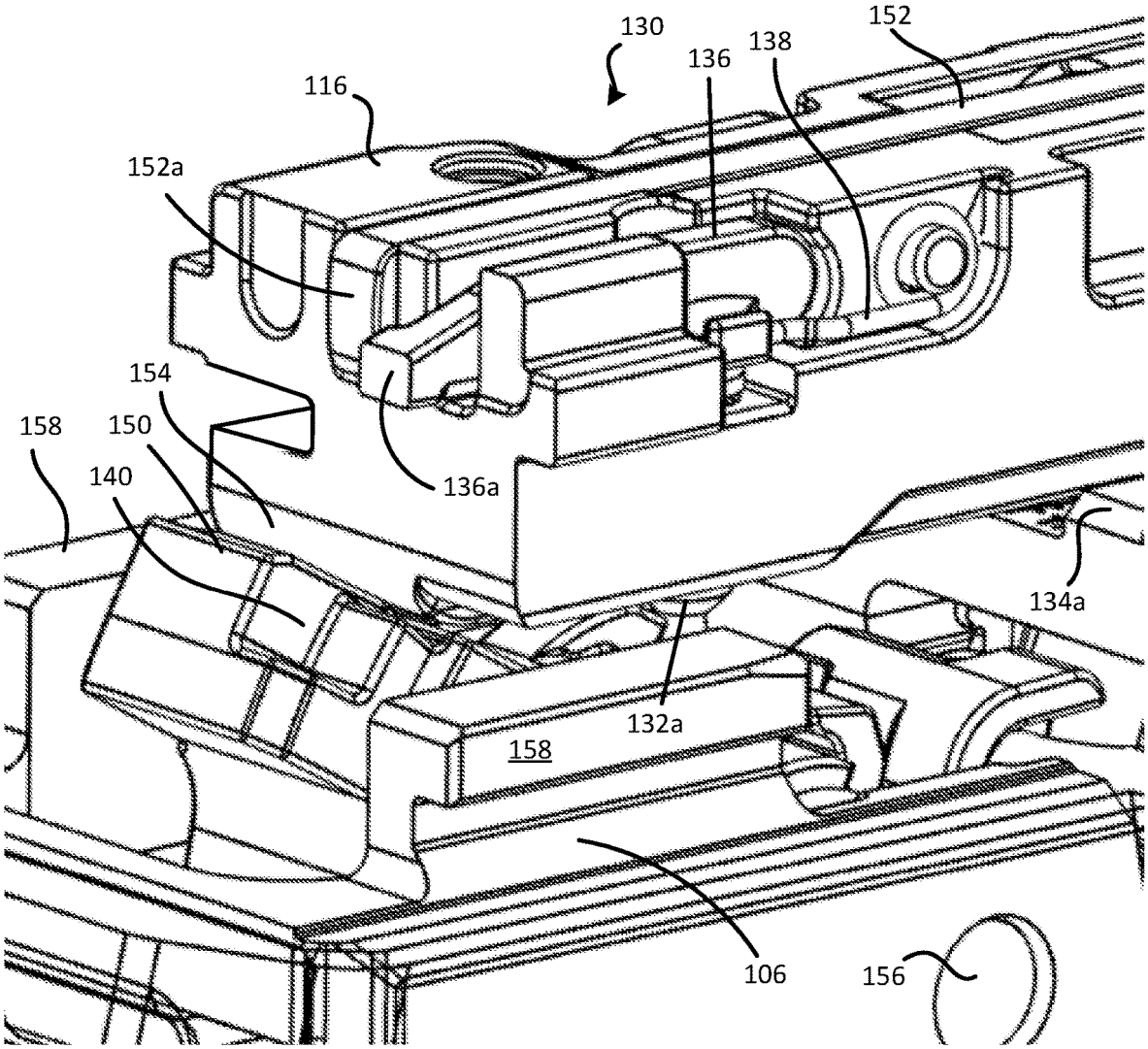
FIG. 10 illustrates a side and rear perspective view showing a breechblock in an out-of-battery position and a safety mechanism with a lever in a blocking position, in accordance with an embodiment of the present disclosure.

FIG. 10 illustrates a top, rear, and side perspective view showing part of the breechblock 116 in an out-of-battery position, components of the safety mechanism 130, and other components of a handgun, in accordance with an embodiment of the present disclosure. The hammer 150 is pivotably attached to the receiver 106 and can pivot about a hammer pin 156 between a cocked position and a fire position. The receiver 106 includes rails 158 along which the slide 108 can reciprocate (slide shown in FIGS. 1-4). In this example, the breechblock 116 is out-of-battery by more than the predefined distance (e.g., ~1.0 mm). Such position may occur while cycling the action, for example. The hammer ramp 154 of the breechblock 116 engages the hammer 150, as also may occur when re-cocking the hammer 150 during rearward movement of the breechblock 116 and slide 108. During rearward movement, the hammer ramp 154 cocks the hammer, but also functions to prevent the hammer 150 from striking the firing pin 152 in the event the hammer is released from a cocked position. The lower end 132*a* of the lift pin 132 is spaced from the ramp 134*a* of the cam 134 and therefore the lift pin 132 is in the first or lowered position. Accordingly, the lever 136 is in a blocking position with the end 136*a* of the lever 136 positioned to obstruct the hammer 150 from contacting the end 152*a* of the firing pin 152 as the hammer 150 rotates towards the fire position. In the event that the breechblock 116 moves forward before the hammer is fully cocked, or if the hammer 150 is released while the breechblock is in an out-of-battery position, for example, the end 136*a* of lever 136 is positioned to prevent the hammer 150 from striking the firing pin 152. Note that the safety mechanism 130 may not take effect in all out-of-battery positions since the hammer ramp 154 can also block the hammer 150 from pivoting when the breechblock 116 is in some out-of-battery positions. The recess 140 in the hammer 150 is also shown. As noted above, the end 136*a* of the lever 136 is received in the recess 140 when the lever 136 is in the raised or non-blocking position.

Figure 11:
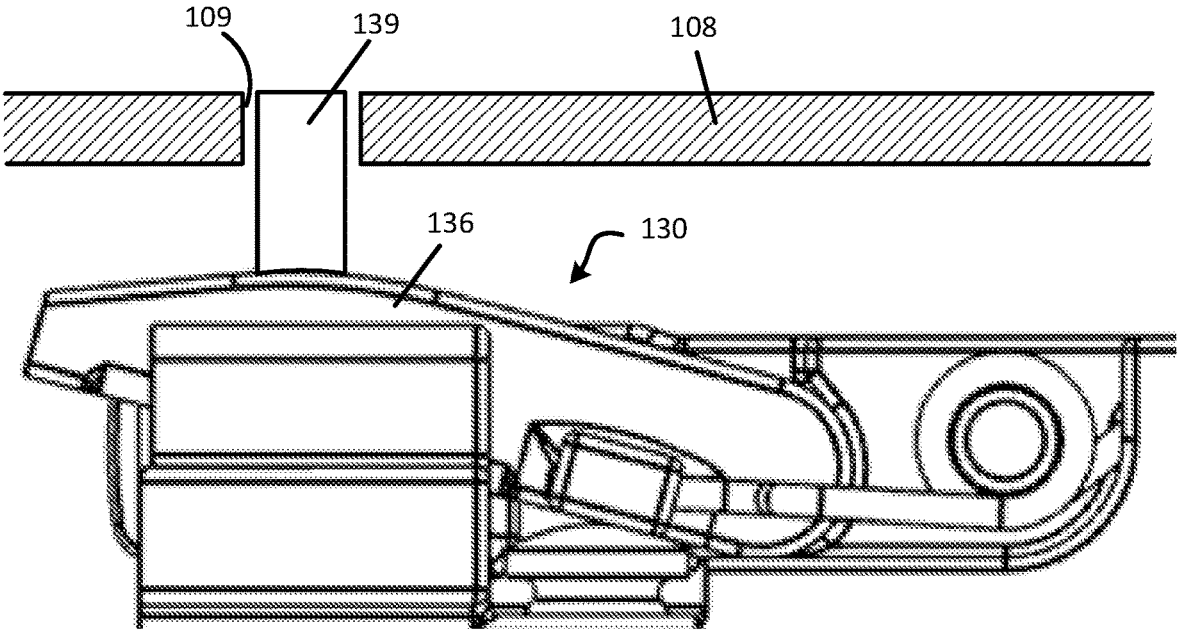
FIG. 11 illustrates a side view showing part of a safety mechanism that includes an indicator of battery condition, in accordance with an embodiment of the present disclosure.

FIG. 11 illustrates a side view showing part of the safety mechanism 130 with a battery condition indicator, in accordance with an embodiment of the present disclosure. In this example, the safety mechanism 130 includes an indicator that is visible to the user to identify whether the breechblock is in battery. As shown here, for example, the indicator is a post 139 extending up from a top of the lever 136 and that protrudes through an opening 109 in the slide 108 when the lever 136 is in the non-blocking position. As discussed above, the non-blocking position corresponds to a battery condition, in accordance with some embodiments. Accordingly, the user can see the top of the post 136 being flush with the top surface of the slide 108, for example, as an indication that the breechblock 116 is in battery. In an out-of-battery condition, on the other hand, the lever 136 would pivot down to the blocking position, drawing the post 139 into the slide 108 and providing a visible indicator to the user that the breechblock is out of battery. The top of the post 139 can include a color or high-visibility coating to facilitate identifying the battery condition.

In use, a safety mechanism 130 in accordance with the present disclosure can prevent a hammer 150 from striking the firing pin 152, or it can prevent a striker from moving forward to strike the primer, when the breechblock 116 is in an out-of-battery position. A safety mechanism 130 as discussed herein can be utilized in a variety of firearms utilizing blowback operation, including semiautomatic handguns, small bore rifles, and other suitable firearms. As applied to semiautomatic handguns, for example, the breechblock can be a component that is distinct from the slide or the breechblock can be machined as part of the slide in a single component. The concepts of the present disclosure can be applied to hammer-fired and striker-fired handguns. For example, when the breechblock 116 is more than a predefined distance from battery, such as more than 1 mm from battery, the lever 136 is positioned to obstruct the hammer from striking the firing pin 152. In some embodiments, the safety mechanism 130 is redundant to the hammer ramp to prevent out-of-battery discharge. In other embodiments, the safety mechanism 130 prevents out-blocking of-battery discharge at smaller distances from the battery position where the hammer ramp 154 may fail by itself to prevent the hammer from striking the firing pin 152.

Although discussed in the context of a lift pin that moves vertically to lift a lever, the safety mechanism 130 is not limited to this movement and similarly can utilize a pin oriented horizontally and that moves laterally to move the lever laterally between blocking and non-blocking positions. Also, the spring 138 disclosed herein is discussed as providing a biasing force toward the blocking position. However, the spring 138 could bias the lever to the non-blocking position, such as where the pin engages the cam in out-of-battery positions and maintains the lever in the blocking position so long as the breechblock is out of battery by more than the predefined distance. Further, the safety mechanism 130 of the present disclosure is not limited to a lever 136 with a pivot movement or limited to a pin with linear movement. For example, the lever can be rotated or displaced between the blocking and non-blocking positions by a pin, toggle, or lever that rotates, pivots, or slides during contact with the lever. Numerous variations and embodiments will be apparent in light of the present disclosure.

Further Example Embodiments

The following examples pertain to embodiments of the present disclosure, from which numerous permutations and configurations will be apparent.

Example 1 is a breechblock assembly for a firearm. The breechblock assembly comprises a breechblock extending along a central axis and configured to reciprocate along a top of a receiver between a recoil position and a battery position. An actuator is slidably received through an opening in the breechblock, the actuator having a lower end and an upper end, wherein the actuator is movable between a first vertical position and a second vertical position. A lever on the breechblock contacts the upper end of the actuator and moves between a lowered position and a raised position. When the actuator is in the first vertical position the lever is in the lowered position, and when the actuator is in the second vertical position the lever is in the raised position.

Example 2 includes the subject matter of Example 1, wherein the lever is generally oriented along the central axis and extends rearward beyond a proximal face of the breechblock.

Example 3 includes the subject matter of Example 1 or 2 and further comprises a spring between the breechblock and the lever, the spring biasing the lever to the blocking position.

Example 4 includes the subject matter of Example 3, wherein the spring is a torsion spring.

Example 5 includes the subject matter of any of Examples 1-4, wherein an upper end of the actuator engages the lever.

Example 6 includes the subject matter of any of Examples 1-5 and further comprises a firing pin movable along the central axis of the breechblock from a rearward position to a forward position, the firing pin having a proximal end that extends through the proximal face of the breechblock when in the rearward position. A firing pin spring between the breechblock and the firing pin biases the firing pin towards the rearward position.

Example 7 is a firearm comprising the breechblock assembly of any of Examples 1-6.

Example 8 includes the subject matter of Example 7, where the firearm is a semiautomatic handgun configured for blowback operation.

Example 9 includes the subject matter of Example 8, wherein the semiautomatic handgun is configured for rimfire ammunition.

Example 10 includes the subject matter of Example 9, wherein the ammunition is .22 cal.

Example 11 includes the subject matter of Example 7, wherein the firearm is a rifle configured for blowback operation.

Example 12 is a safety mechanism for a self-loading firearm configured for blowback operation, the safety mechanism comprising a receiver including a cam surface; a hammer or striker coupled to the receiver and movable between a cocked position and a fire position; a breechblock configured to reciprocate along a top of the receiver between a recoil position and a battery position; an actuator on the breechblock, the actuator having an end positioned to engage the cam surface on the receiver when the breechblock is within a predefined distance from the battery position; and a lever actuatable by the actuator and configured to move from a blocking position to a non-blocking position when the actuator engages the cam surface. When the breechblock is out of the battery position by more than the predetermined distance, the actuator is in a first position and the lever is in the blocking position, and when the breechblock is within the predefined distance of the battery position the actuator is in a second position and the lever is in the non-blocking position.

Example 13 includes the subject matter of Example 12, where the actuator is a pin oriented vertically and extending through part of the breechblock.

Example 14 includes the subject matter of Example 13, where the end of the actuator positioned to engage the cam surface is a lower end of the pin.

Example 15 includes the subject matter of any of Examples 12-15, where the cam surface includes a ramp, wherein when the breechblock moves to the battery position, the end of the actuator engages the ramp and moves the actuator, thereby causing the lever to move from the blocking position to the non-blocking position.

Example 16 includes the subject matter of Example 15, where the breechblock moves to the battery position, the actuator moves vertically and lifts the lever from the blocking position to the non-blocking position.

Example 17 includes the subject matter of any of Examples 12-16, where the hammer defines a recess configured and arranged so that an end of the lever is positioned to occupy the recess when the lever is in the non-blocking position and so that the end of the lever is positioned to contact part of the hammer when the lever is in the blocking position.

Example 18 includes the subject matter of any of Examples 12-17 and further comprises a spring between the breechblock and the lever, the spring biasing the lever to the blocking position.

Example 19 includes the subject matter of Example 18, where the spring is a torsion spring having a first leg engaging the breechblock and a second leg engaging the lever.

Example 20 includes the subject matter of any of Examples 12-19, where the predefined distance is not more than 1.0 mm.

Example 21 includes the subject matter of Example 20, where the predefined distance is not more than 0.8 mm.

Example 22 is a handgun comprising the safety mechanism of any of Examples 12-21.

Example 23 includes the subject matter of Example 22, where the handgun is a semiautomatic handgun configured for rimfire ammunition.

Example 24 includes the subject matter of Example 22 or 23, where the receiver defines a chamber and the handgun comprises a barrel fixedly secured to the receiver with a bore of the barrel aligned coaxially with the chamber.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A breechblock assembly for a firearm, the breechblock assembly comprising:

a breechblock extending along a central axis and configured to reciprocate along a top of a receiver between a recoil position and a battery position;

an actuator slidably received through an opening in the breechblock, the actuator having a first end and a second end, wherein the actuator is movable between a first vertical position and a second vertical position;

a lever on the breechblock, the lever in contact with the second end of the actuator and movable between a blocking position and a non-blocking position in response to the actuator moving between the first vertical position and the second vertical position; and a spring between the breechblock and the lever, the spring biasing the lever to the first vertical position;

wherein when the actuator is in the first vertical position the lever is in the blocking position and prevents the firearm from firing, and when the actuator is in the second vertical position the lever is in the non-blocking position.

2. The breechblock assembly of claim 1, wherein the lever is generally oriented along the central axis and extends rearward beyond a proximal face of the breechblock.

3. The breechblock assembly of claim 2, wherein the second end of the actuator is an upper end.

4. The breechblock assembly of claim 2, further comprising:

a firing pin movable along the central axis of the breechblock from a rearward position to a forward position, the firing pin having a proximal end that extends through the proximal face of the breechblock when in the rearward position; and a firing pin spring between the breechblock and the firing pin, the firing pin spring biasing the firing pin towards the rearward position.

5. A firearm comprising the breechblock assembly of claim 4.

6. The firearm of claim 5, wherein the firearm is a semiautomatic handgun configured for blowback operation.

7. The firearm of claim 6, wherein the semiautomatic handgun is configured for rimfire ammunition.

8. The firearm of claim 5, wherein the firearm is a rifle configured for blowback operation.

9. A safety mechanism for a self-loading firearm configured for blowback operation, the safety mechanism comprising:

a receiver including a cam surface;

a hammer or striker coupled to the receiver and movable between a cocked position and a fire position;

a breechblock configured to reciprocate along a top of the receiver between a recoil position and a battery position;

an actuator on the breechblock, the actuator having an end positioned to engage the cam surface on the receiver when the breechblock is within a predefined distance from the battery position;

a lever actuatable by the actuator and configured to move from a blocking position to a non-blocking position when the actuator engages the cam surface;

wherein when the breechblock is out of the battery position by more than the predetermined distance, the actuator is in a first position and the lever is in the blocking position, and when the breechblock is within the predefined distance of the battery position the actuator is in a second position and the lever is in the non-blocking position.

10. The safety mechanism of claim 9, wherein the actuator is a pin oriented vertically and extends through part of the breechblock.

11. The safety mechanism of claim 10, wherein the end of the pin positioned to engage the cam surface is a lower end of the pin.

12. The safety mechanism of claim 9, wherein the cam surface includes a ramp, wherein when the breechblock moves to the battery position, the end of the pin engages the ramp and moves the pin, thereby causing the lever to move from the blocking position to the non-blocking position.

13. The safety mechanism of claim 12, wherein the breechblock moves to the battery position, the actuator moves vertically and lifts the lever from the blocking position to the non-blocking position.

14. The safety mechanism of claim 9, wherein the hammer defines a recess configured and arranged so that an end of the lever is positioned to occupy the recess when the lever is in the non-blocking position and so that the end of the lever is positioned to contact part of the hammer when the lever is in the blocking position.

15. The safety mechanism of claim 9, further comprising a spring between the breechblock and the lever, the spring biasing the lever to the blocking position.

16. The safety mechanism of claim 9, wherein the predefined distance is not more than 1.0 mm.

17. A handgun comprising the safety mechanism of claim 9.

18. The handgun of claim 17, wherein the handgun is configured for rimfire ammunition.

19. The handgun of claim 18, wherein the receiver defines a chamber and the handgun comprises a barrel fixedly secured to the receiver with a bore of the barrel aligned coaxially with the chamber.

* * * * *